US007208052B2

(12) United States Patent
Hammond et al.

(10) Patent No.: US 7,208,052 B2
(45) Date of Patent: Apr. 24, 2007

(54) METHOD FOR CARBURIZING STEEL COMPONENTS

(75) Inventors: Stephen N. Hammond, Brownsburg, IN (US); Udayan Trivedi, Indianapolis, IN (US); Thomas L. Doubts, Heber City, UT (US); Douglas C. Steckbauer, Park City, UT (US)

(73) Assignee: Rolls-Royce Corporation, Indianapolis, IN (US)

( * ) Notice: Subject to any disclaimer, the term of this patent is extended or adjusted under 35 U.S.C. 154(b) by 114 days.

(21) Appl. No.: 10/765,300

(22) Filed: Jan. 27, 2004

(65) Prior Publication Data

US 2005/0133119 A1 Jun. 23, 2005

Related U.S. Application Data

(60) Provisional application No. 60/531,831, filed on Dec. 23, 2003.

(51) Int. Cl.
*C23C 18/54* (2006.01)
*C23C 8/20* (2006.01)
*B24C 1/00* (2006.01)

(52) U.S. Cl. ..... 148/225; 148/206

(58) Field of Classification Search ..... 148/225
See application file for complete search history.

(56) References Cited

U.S. PATENT DOCUMENTS 3,827,920 A 8/1974 Shimoda et al.
4,013,487 A * 3/1977 Ramqvist et al. ..... 148/220
4,568,393 A 2/1986 Kane et al.
5,000,368 A * 3/1991 Turner ..... 228/131
5,653,822 A 8/1997 Stickels et al.
5,702,540 A * 12/1997 Kubota ..... 148/223
5,792,282 A 8/1998 Tahara et al.
6,093,303 A 7/2000 Williams et al.
6,149,734 A 11/2000 Isogai et al.
6,218,642 B1 * 4/2001 Christmas et al. ..... 219/121.66
6,413,326 B1 7/2002 Rallis
6,458,218 B1 10/2002 Savich
6,461,448 B1 10/2002 Williams et al.
2006/0090817 A1 * 5/2006 Somers et al. ..... 148/218

OTHER PUBLICATIONS

Davis et al., ASM Handbook, 1995, ASM International, vol. 4, 203, 262, 321, 348-349, 363-364 and 714.*
Davis et al., Metals Handbook, 1990, ASM International, vol. 1, 841.*
U.S. Appl. No. 60/401,215.*
Davis et al., ASM Handbook, 1995, ASM International, vol. 4, pp. 33-34, 259-263 and 348-351.*

* cited by examiner

*Primary Examiner*—Roy King
*Assistant Examiner*—Jessee Roe
(74) *Attorney, Agent, or Firm*—Krieg DeVault, LLP

(57) ABSTRACT

A carburizing process for increasing the hardness of a case region of a steel component. In one form the application includes plating the outer surface of a stainless steel component with nickel prior to carburizing. One component includes a stainless steel object having a hardened case substantially free of continuous phase grain boundary carbides.

34 Claims, 6 Drawing Sheets

METHOD FOR CARBURIZING STEEL COMPONENTS

CROSS REFERENCE TO RELATED APPLICATIONS

The present application claims the benefit of U.S. Provisional Application No. 60/531,831 filed Dec. 23, 2003. This United States Provisional Application is entitled METHOD FOR CARBURIZING STEEL COMPONENTS and is incorporated herein by reference.

BACKGROUND OF THE INVENTION

The present invention relates generally to a process for carburizing a steel component to increase the surface hardness of the material. More particularly, in one form the present inventive process includes electroless nickel plating the outer surface of a martensitic stainless steel component prior to vacuum carburizing. Although the present invention was developed for processing components formed of stainless steel, certain applications extend outside of this field.

In the design and manufacture of steel components, there is often a need to modify properties of the material. It is well recognized that carburizing is a process suited for hardening the surface and sub-surface of the steel component. Carburizing can be broadly considered as either an atmospheric carburization process or a vacuum carburization process. In the vacuum carburization process, the component is heated to an elevated temperature within a carburizing furnace, and a carburizing gas is introduced into the environment so that carbon atoms are diffused into the surface and sub-surface of the steel material. The carbon content in the surface and near sub-surface of the component is increased while the carbon content within the core of the component remains unaltered. The characteristics of the component have thus been modified to provide a hardened outer surface surrounding an interior core.

In response to the continued demand for new goods and services, engineers and scientists are always seeking to enhance products through material selection and/or process development. Stainless steel is widely utilized in many components in a vast array of products. One stainless steel of interest is available under the tradename, Pyrowear 675. A known technique associated with carburizing the Pyrowear 675 component is to oxidize the surface of the component prior to exposure to the carburizing environment. The component is grit blasted and placed in an air furnace at a temperature of 1800° F. for about one hour to form an oxide on its surface. Upon the component being subjected to the carburizing environment, the oxidized surface facilitates the absorption of carbon by the material.

In a carburizing process the time and temperature that the material is subjected to while in the carburizing environment will determine the surface hardness, case depth, hardness profile, and carbide microstructure of the hardened portion of the material. In the prior method discussed above, after carburization the Pyrowear 675 material is annealed, hardened, annealed, hardened, stabilized in a deep freeze, tempered, brought to room temperature, and then tempered again. With reference to FIG. 1, there is illustrated a prior heat treat cycle for carburizing and hardening the Pyrowear 675 material. Further, with reference to FIG. 2, there is illustrated a hardness profile for a carburized Pyrowear 675 component that was processed with the heat treat cycle set forth in FIG. 1.

While there are many prior processes for carburizing steel components, there remains a need for additional development in this area. In furtherance of this need, the present invention provides a novel and non-obvious means for carburizing steel.

SUMMARY OF THE INVENTION

One form of the present invention contemplates a method of increasing the hardness of a steel object. The method comprising: applying a nickel plating to at least a portion of a surface of the steel object; subjecting the steel object to carburizing to allow carbon atoms to diffuse through the nickel plating and form a case portion at a depth greater than or equal to 0.012 inches; and heat treating the steel object after said subjecting and the case portion having a hardness of at least Rc 50.

Another form of the present invention contemplates a method of processing a steel object, comprising: plating a surface of the steel object with an electroless nickel material; heating the steel object to a carburizing temperature; subjecting the steel object to carburizing wherein carbon atoms diffuse through the plating and form a hardened case region; and removing at least a portion of the electroless nickel material after said subjecting.

Another form of the present invention contemplates a method comprising: (a) applying an electroless nickel plating to a surface on a stainless steel object; (b) placing the object within a mechanical housing; (c) evacuating the environment within the mechanical housing to a sub-atmospheric pressure; (d) heating the object within the mechanical housing to a carburizing temperature; (e) introducing a carburizing gas into the mechanical housing for a first period of time; (f) drawing a vacuum within the mechanical housing for a second period of time; and (g) repeating acts (c)–(f) a plurality of times.

Yet another form of the present invention contemplates an apparatus comprising: a steel body having a hardened carburized case portion and a core portion, wherein said case portion has a hardness of at least Rc 50 and is substantially free of continuous phase grain boundary carbides.

Yet another form of the present invention contemplates an apparatus comprising: a stainless steel body having a hardened carburized case having a depth greater than or equal to 0.012 inches and a hardness greater than Rc 60.

One form of the present invention contemplates a unique process for carburizing a steel component.

Related objects and advantages of the present invention will be apparent from the following description.

DESCRIPTION OF THE PREFERRED EMBODIMENTS

Figure 1:
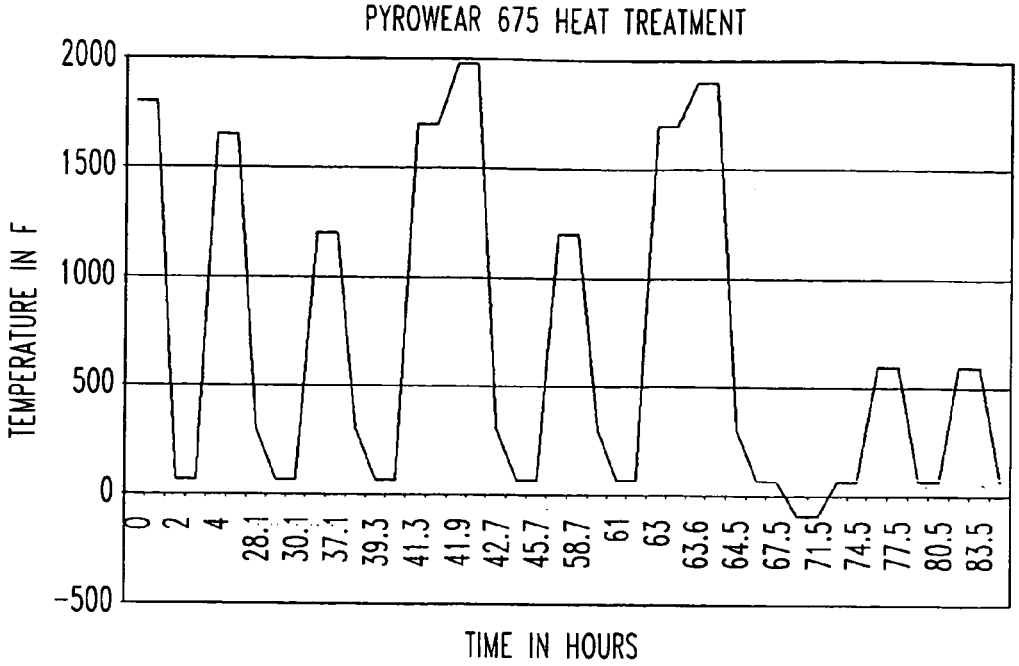
FIG. 1 is a time-temperature plot illustrating a prior heat treat cycle for carburizing and hardening Pyrowear 675.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Steels can be carburized and hardened to achieve a case with a hardness higher than the core. When a steel containing chromium is carburized, the carbon can unite with the chromium and form a chromium carbide. Different forms of chromium carbide go into solution at different temperatures. The chromium carbides can participate out at the iron grain boundaries and form a continuous phase along iron grain boundaries. This network will weaken the material in the case because the continuous phase along the grain boundaries will make it brittle and more easily cracked than if this continuous phase did not exist. If chromium carbides are small and uniformly dispersed within the iron the material is not mechanically degraded and may have enhanced wear resistance.

Figure 2:
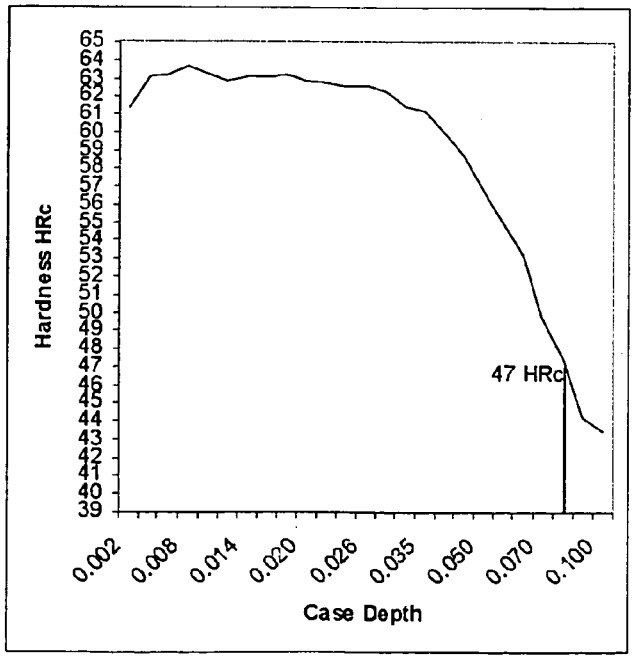
FIG. 2 illustrates a hardness profile of a Pyrowear 675 component that has been carburized and heat treated by the heat treat cycle set forth in FIG. 1.
Figure 2A:
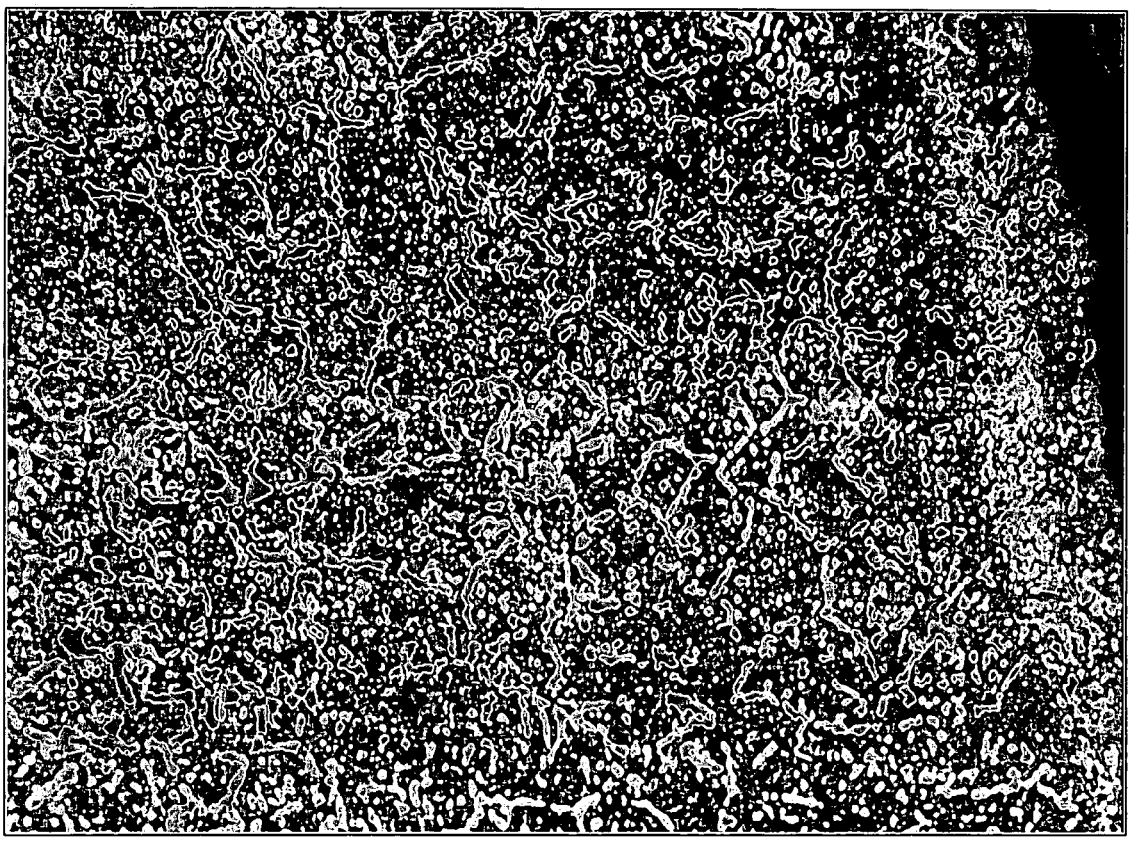
FIG. 2*a* is a micrograph illustrating the Pyrowear 675 carburized and hardened microstructure without using the nickel plating surface preparation prior to carburizing.

With reference to FIG. 2*a*, there is illustrated a micrograph showing one form of chromium carbides participated out at the grain boundaries in a large size and forming a continuous phase along the iron grain boundary in a piece of Pyrowear 675. The chromium carbides when formed in a large size and in a continuous phase along the grain boundaries of the iron depletes the iron matrix of chromium that was previously in solution in the iron. Without the original amount of chromium in solution in the iron, the steel's corrosion resistance is degraded. If fine uniformly distributed carbides exist, this condition has less effect upon the corrosion resistance of the steel than a condition of large carbides with a network in the iron's grain boundaries.

The inventors in the present application find that the carburizing of chromium containing steels with a nickel plating on the surface, facilitates the diffusion of carbon within the steel without forming large carbides nor a continuous phase of carbides along the grain boundaries. Further, the inventors in the present application have found that they can control the formation of carbides in a carburizing process by controlling the thickness of the nickel plating. In one application, the component is designed to have a case with substantially no carbides and a thinner nickel plating is utilized. In another application, it is desired to have fine uniformly dispersed carbides; then, a thicker nickel plating is utlized.

Figure 3:
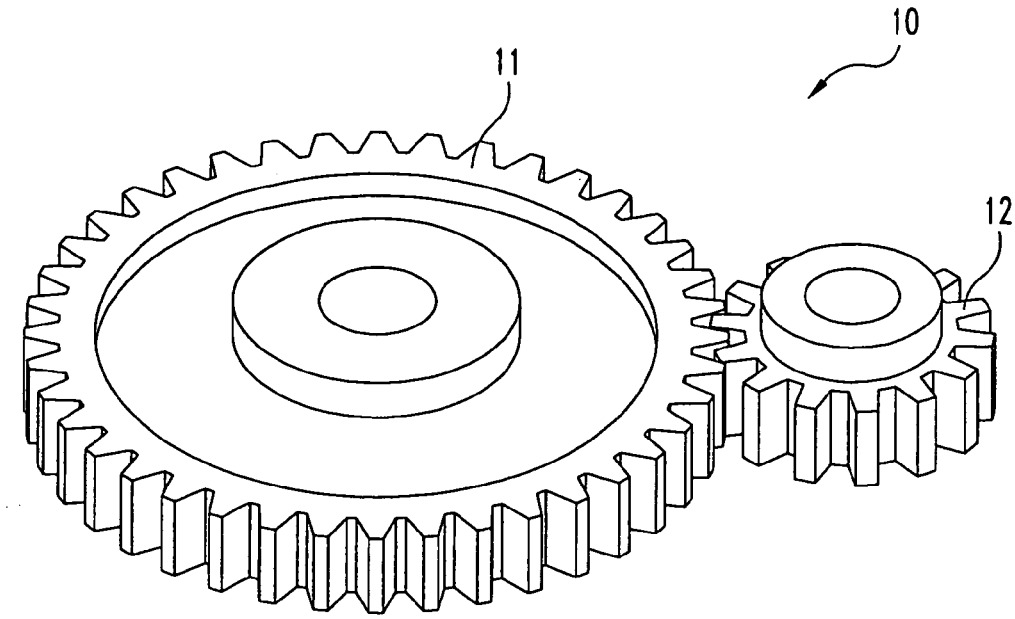
FIG. 3 is an illustration of a gear set.

With reference to FIG. 3, there is illustrated a gear set 10 including gear 111 and 12. The gear set 10 is purely illustrative, and is not intended to be limiting. The present invention contemplates a process that is applicable to use on any type of gear with no limitation intended based on the specific type of gear. As will be described in detail below, the present description will set forth a process for carburizing a component or portion of the component, such as but not limited to gears. The process can be utilized on a variety of types of materials, including but not limited to wrought materials. Conventional processes may thereafter machine the component. The machined component will have surfaces and regions below the surface that have a hardened case region. However, the present invention also contemplates that the component may also not be machined after the hardening techniques.

Figure 4:
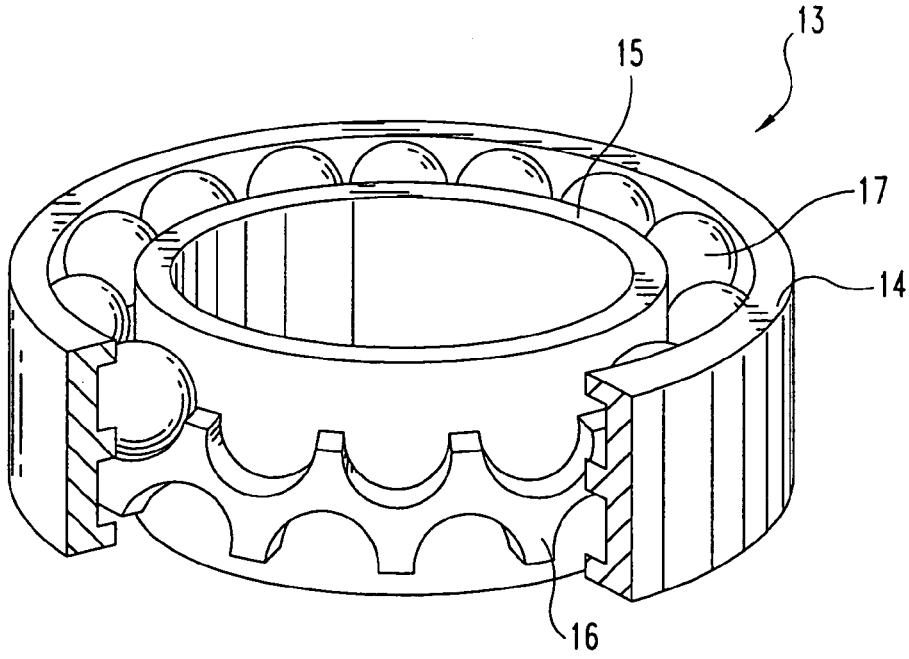
FIG. 4 is a partially fragmented view of a rolling element bearing.

Referring to FIG. 4, there is illustrated a rolling element bearing 13. The rolling element bearing 13 illustrated in FIG. 4 is a ball bearing type rolling element bearing; however, other types of rolling element bearing, including, but not limited to, roller and tapered roller bearings, are contemplated herein. Bearing 13 includes an outer bearing race 14, inner bearing race 15, a cage 16, and a plurality of ball bearings 17. The bearing 13 in FIG. 4 can be a hybrid or completely metallic system. In one form, bearing 13 is formed of a material that is compatible with the process for carburizing the entire component or portions of the component as set forth below. The present invention finds application with any type of part, component and/or article and is not limited in anyway to gears or bearings.

Figure 5:
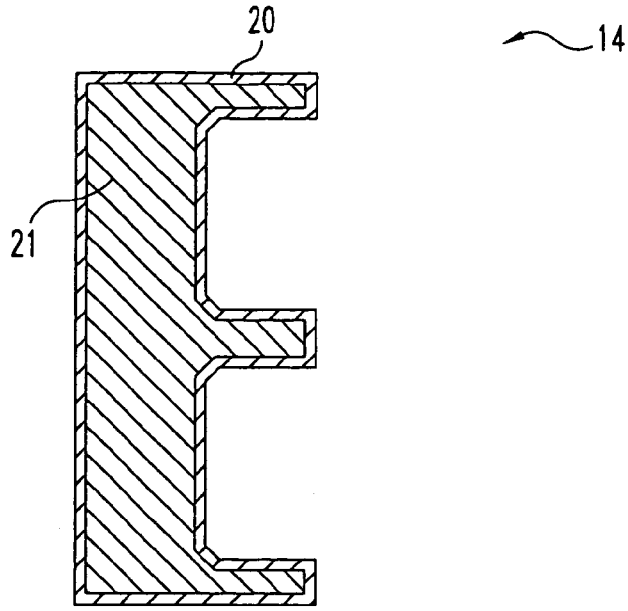
FIG. 5 is a cross-sectional view of an outer bearing race that has been processed by one form of the present invention.
Figure 6:
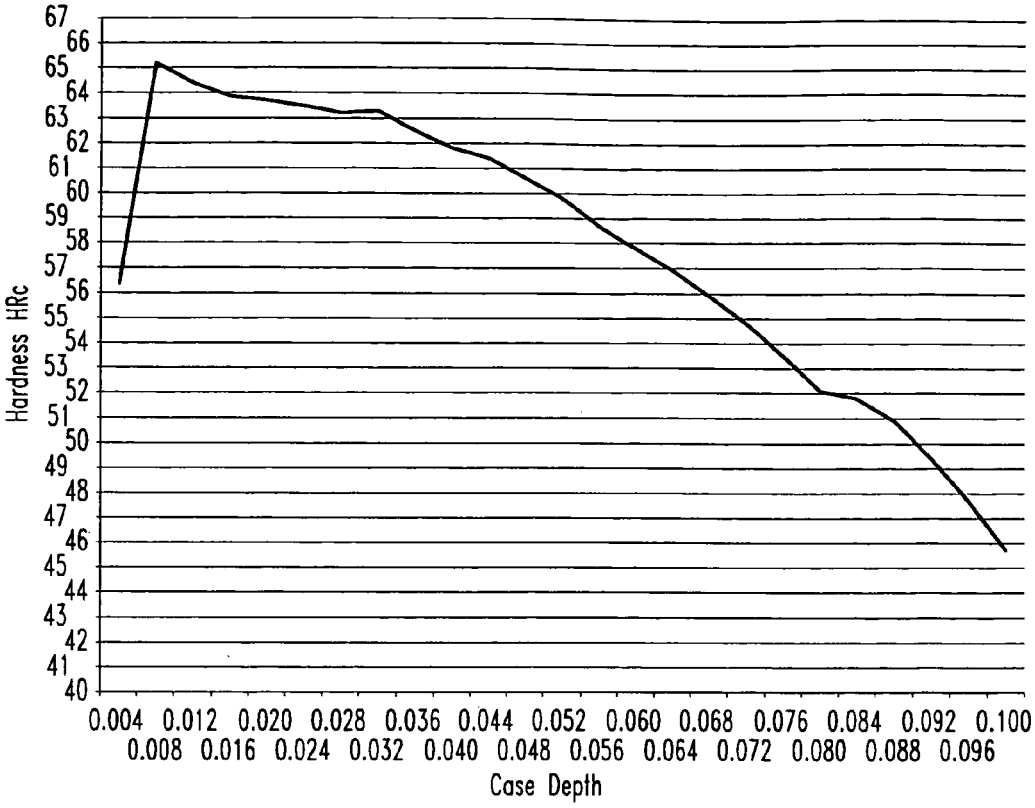
FIG. 6 is a plot illustrating hardness (HRC) versus case depth for a Pyrowear 675 component having a nickel plating thickness of 0.001 inches prior to carburizing.

With reference to FIG. 5, there is illustrated an enlarged cross-sectional view of the outer bearing race 14 that has been subjected to a carburizing process of the present invention. The outer bearing race 14 includes a case portion 20 and a core portion 21. The case portion 20 is formed by the carburizing process of the present invention and has hardness greater than that of the core portion 21. In one form of the present invention the case portion with hardness to at least HRc 50 extending to a depth greater than about 0.012 inches. In a preferred form the case portion has a hardness of at least HRc 50 in a case depth within a range of about 0.012 inches to about 0.090 inches below the surface of the component. The hardness within the case portion will decrease from the surface to the core. With reference to FIG. 6, there is illustrated a plot of hardness HRc vs. case depth for a Pyrowear 675 material that has been carburized and hardened utilizing one form of the present invention. However, the present application contemplates other case depths and harnesses and is not intended to be limited to the specific examples unless specifically stated to be limited thereto.

The present carburizing process is applicable for use on all stainless steel materials, including ferretic, martinsitic and austentic materials. Further, the present carburizing process is applicable to other types of steel materials, In a more preferred form of the present invention the material is a martinsitic stainless steel known by the tradename, Pyrowear 675. Pyrowear 675 is stainless steel having the following nominal chemical composition in weight percent: chromium (Cr) 13%; nickel (Ni) 2.85%; molybdenum (Mo) 1.8%; cobalt (Co) 5.3%; magnanese (Mn) 0.7%; vanadium (V) 0.6%; and the balance iron (Fe). While the preferred embodiments will be described with specific reference to articles made of stainless steel, such descriptions are exemplary in nature and should not be construed in a limiting sense unless specifically provided to the contrary.

The present method of forming a case portion in the component includes subjecting the outer surface of the component to a surface preparation act prior to subjecting the component to the carburizing environment. Carburization in general includes subjecting the component to an environment wherein carbon atoms can be diffused into the material through the outer surface of the component. Carburizing as utilized herein includes any type of carburization including but not limited to atmospheric and/or vacuum. In the present process nickel plating is deposited onto the external surface of the component prior to the component being subjected to the carburizing environment. The nickel plating can be applied by electroless nickel plating or an electroplating (galvanic) technique. The present process preferably utilizes the electroless nickel plating process, which is also known as chemical or auto-catalytic nickel plating. Electroless nickel plating is a process to deposit a deposition alloy of nickel based upon the catalytic reduction of nickel ions on the outer surface of the component. The component to receive the electroless nickel plate is soaked in a chemical nickel plating bath in order to receive a deposit of the nickel deposition alloy having a desired thickness onto the outer surface of the component. Chemical nickel plating baths are readily available from chemical supply houses, and one bath suitable for forming an electroless nickel deposition alloy coating on a component is sold by McDermit under the tradename NiClad 724. In one form of the present invention, the chemical nickel plating bath is run at a temperature of about 185° F. to about 190° F. It is understood that the present application is not limited to the particular chemical nickel plating bath and temperatures set forth herein and other chemical nickel plating baths and temperatures are contemplated herein.

Figure 5A:
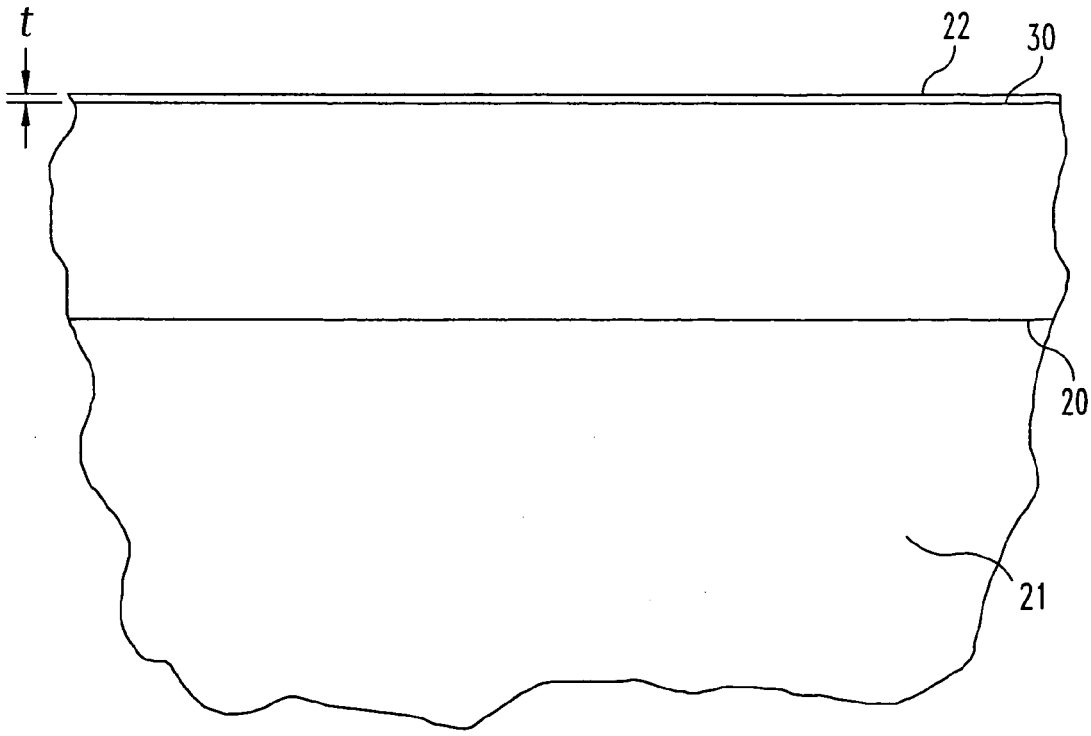
FIG. 5*a* is a schematic representation of the electroless nickel plating layer applied to the steel component.

With reference to the FIG. 5*a*, there is illustrated an illustrative portion of the component including the nickel plating layer 22, which has been deposited onto the surface 30 of the component. FIG. 5*a* also provides an illustration of the case portion 20 that will be formed during the carburizing phase of the present process. The drawing set forth in FIG. 5*a* is not drawn to scale and is provided to show the relative location of the nickel plating layer on the component. The thickness 't' of the electroless nickel plating layer 22 will depend on the deposition rate associated with the chemical nickel bath and the length of time that the component is subjected to the chemical bath. A property associated with electroless nickel plating is the ability to cover the surface with a uniform thickness of nickel deposition alloy. However, in one form of the present invention, a portion of the outer surface 30 has been masked/coated with a Paraffin material to prevent the deposition of the nickel alloy coating on this portion of the outer surface. The prevention of the nickel plating on the portion of outer surface 30 substantially eliminates the ability for case hardening to occur as desired by the present process.

In one form of the present invention, the desired electroless nickel plating is a deposition alloy of about 85 to 98 percent nickel (Ni) and about 2 to 15 percent phosphorous by weight percent. In a preferred form, the electroless nickel plating is a deposition alloy of about of about 92 to 98 percent nickel (Ni) and about 2 to 8 percent phosphorous by weight percent. In a more preferred form, the electroless nickel plating is a deposition alloy of about 96 to 98 percent nickel (Ni) and about 2 to 4 percent phosphorous by weight percent. In one form the electroless nickel plating has a thickness 't' within a range of about 0.0005 inches to about 0.0025 inches. More preferably, the thickness 't' is within a range of about 0.0005 inches to about 0.0015 inches. The Pyrowear 675 component that will be subjected to vacuum carburizing will preferably have a plating thickness 't' within a range of about 0.0005 inches to about 0.0015 inches. However, other nickel plating thickness 't' are contemplated herein.

The component having the nickel plating/coating is placed within a carburizing furnace and heated to the carburizing temperature. In one form of the present invention, the component formed of the stainless steel Pyrowear 675 is heated to a temperature within the range of about 1600° F. to about 1700° F., and more preferably to a temperature of about 1650° F. A deposition alloy having about 4 or less weight percent phosphorous has been found capable of withstanding the 1650° F. carburizing temperature without melting the plating.

As discussed above the present application contemplates the utilization of all types of carburization processes including but not limited to vacuum and/or atmospheric. The preferred carburizing process is a vacuum carburizing process in which the carburizing gas is introduced into the carburizing furnace to allow carbon atoms to diffuse through the outer surface of the component and develop the case portion. In one form the carburizing gas is defined by propane, however other carburizing gases are contemplated herein, including but not limited to Methane, Acetylene, and combinations of these gases. As will be understood by one of ordinary skill in the art, the length of time and the temperature at which the carbon atoms diffuse into the Pyrowear 675 will determine the surface hardness, case hardness profile, and carbide type, size and distribution in the case portion.

In one form the vacuum carburizing process includes the following cycle. The environment within the carburizing furnace was evacuated to a sub-atmospheric pressure. The temperature of the component is raised to the desired carburizing temperature by adding heat into the carburizing furnace and the temperature is maintained at the carburizing temperature during the carburizing process. Thereafter, carburizing gas is admitted into the chamber for a period of time. As the carburizing gas is being admitted into the carburizing furnace, a pump is operated to draw a further vacuum within the furnace. The drawing of the vacuum continues for a period of time and commences upon the introduction of carburizing gas into the furnace. Upon the completion of the predetermined time for drawing the vacuum with the pump the cycle is repeated a plurality of times. Upon the completion of the plurality of cycles forming the active carbon diffusion cycle, the process may then include a post carburizing passive diffusion time. In one form the post carburizing passive diffusion time occurs at the same temperature as the active carbon diffusion cycle but without the addition of any further carburizing gas. This post carburizing passive diffusion time will enable the carbon atoms to diffuse further into the material. Upon completion of the active carbon diffusion cycle or the post carburizing passive diffusion cycle the component is then cooled from the carburizing temperature rapidly by quenching in a quenching material. In one form the quenching material is selected from oil, water and an inert gas, however other quenching materials are contemplated herein. In another form of the present invention the component is cooled from the carburizing temperature by a slower cooling process.

The component is then subjected to post thermal cycles such as annealing, hardening, stabilizing and tempering. One form of the post thermal cycle will be described below.

However, it should be understood that other post thermal cycles are contemplated herein. After carburizing, the carburized material is annealed at about 1200° F. for about 6 hours, then furnace cooled to below 200° F. This portion of the cycle places the steel in a softer condition suitable for a conventional machining operation. In one form of the present invention, after the annealing process at least a portion of the nickel plating is removed from the component prior to further acts to harden the component. In a preferred form of the present invention, after the annealing process the entire nickel plating is removed from the component prior to further acts to harden the component. Chemical means, mechanical process and/or grit blasting may remove the nickel plating.

The carburized and annealed material is then hardened at elevated temperatures from a range of about 1800° F. to about 1975° F. and held for about 40 minutes followed by rapid cooling such as an oil quench, water quench, or gas fan cooling. Hardening at these elevated temperatures puts carbides into solution in the iron. Upon rapid cooling some uniform carbides may participate out, however, the remaining carbon stays within the iron causing it to transform to a martensitic structure high in carbon and therefore high in hardness. After hardening the material a first time, the material can be annealed at about 1200° F. and slow cooled (furnace cooled) and then re-hardened a second time to achieve a more homogenous microstructure and a deeper case depth having a hardness of HRc 50. This second hardening may be desirable but is not always necessary and depends upon the design parameters including case depth and desired microstructure.

After the material is hardened, either single or double hardening, the material is cooled below room temperature, or stabilized. Within about one hour after reaching room temperature, the material is cooled to a temperature not warmer than about −90° F. and held at not warmer than about −90° F. for not less than about two hours. After this stabilization phase, the object is air warmed to room temperature. Upon completion of the stabilization process, the material is tempered. Within about one hour after reaching room temperature, the object is tempered by heating the object in a circulating air furnace maintained at about 600° F. for about two hours. In a preferred form, the temperature is maintained within a range of 600° F.±25° F. for two hours±fifteen minutes and then cooled to room temperature. The tempering cycle can be repeated once or a plurality of times as required obtaining specific material properties.

In one form of the present invention the stainless steel Pyrowear 675 component with an electroless nickel deposition alloy coating is placed within the vacuum carburizing furnace. A cycle within the furnace was run including the following. The environment within the carburizing furnace was evacuated to a sub-atmospheric pressure of about one torr. The furnace was heated to bring the temperature therein to a desired carburizing temperature. Thereafter, carburizing gas having a carbon content is admitted into the chamber for about one minute. As the carburizing gas is being admitted into the carburizing furnace, a pump is operated to draw a further vacuum within the furnace. The drawing down of the pressure within the furnace continues for a period of four minutes as measured from when the carburizing gas began entering into the furnace. Upon the completion of the predetermined time of four minutes for drawing down the pressure within the furnace the cycle is terminated. This cycle is repeated 520 times during the active carbon diffusion cycle. Upon completion of the active carbon diffusion cycle, the component undergoes a post carburizing passive diffusion time. The post carburizing passive diffusion time occurs at the same temperature as the active carbon diffusion cycle but without the addition of any further carburizing gas into the furnace. Thereafter, upon completion of the post carburizing passive diffusion cycle the component is cooled from the carburizing temperature rapidly by quenching in oil heated to 140° F. The component is then subjected to an annealing process.

Figure 7:
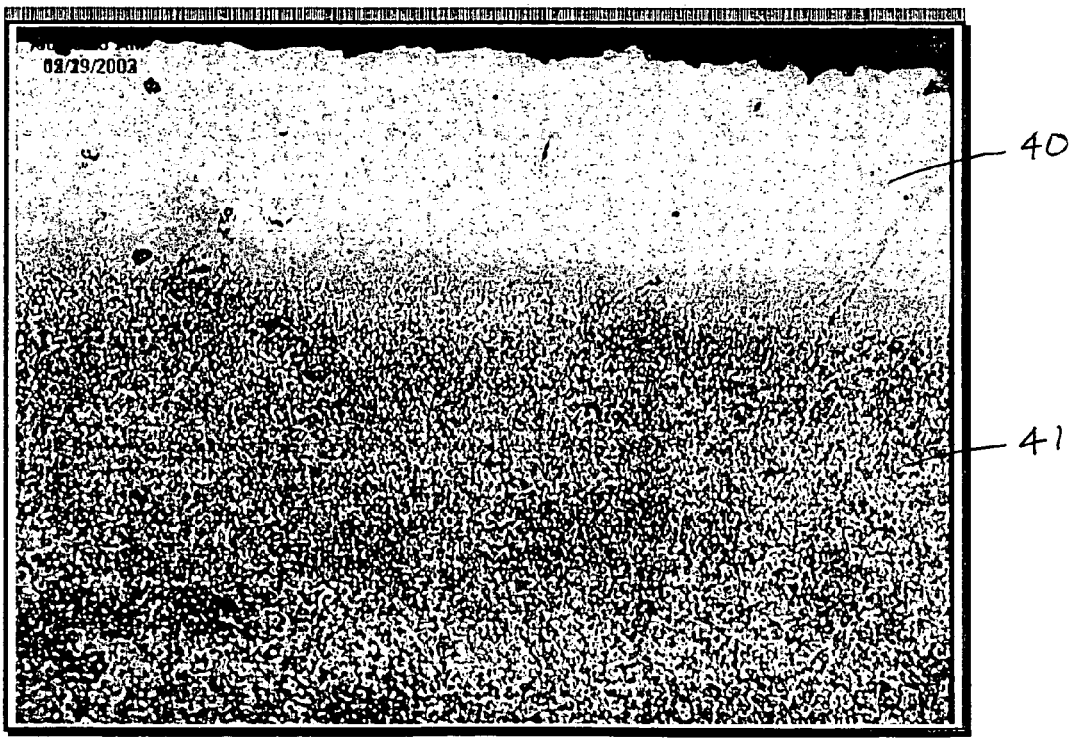
FIG. 7 is a micrograph illustrating the Pyrowear 675 carburized and hardened microstructure obtained using the nickel plating surface preparation prior to carburizing.
Figure 8:
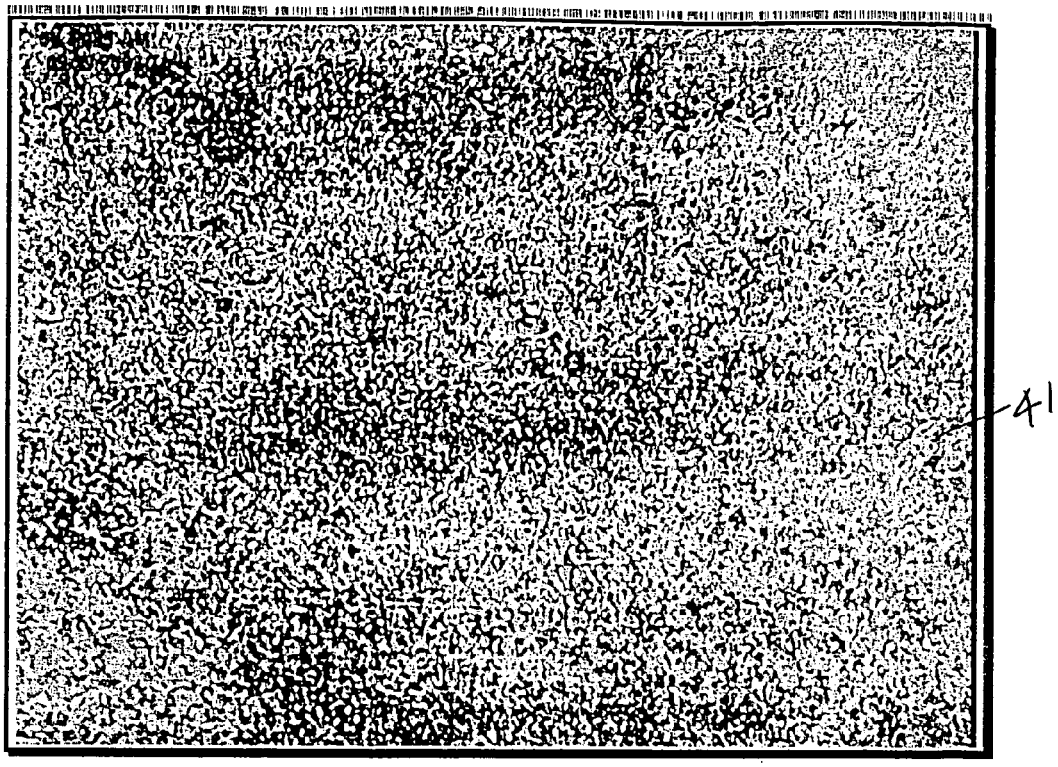
FIG. 8 is a micrograph illustrating the Pyrowear 675 carburized and hardened microstructure obtained using the nickel plating surface preparation prior to carburizing.
Figure 9:
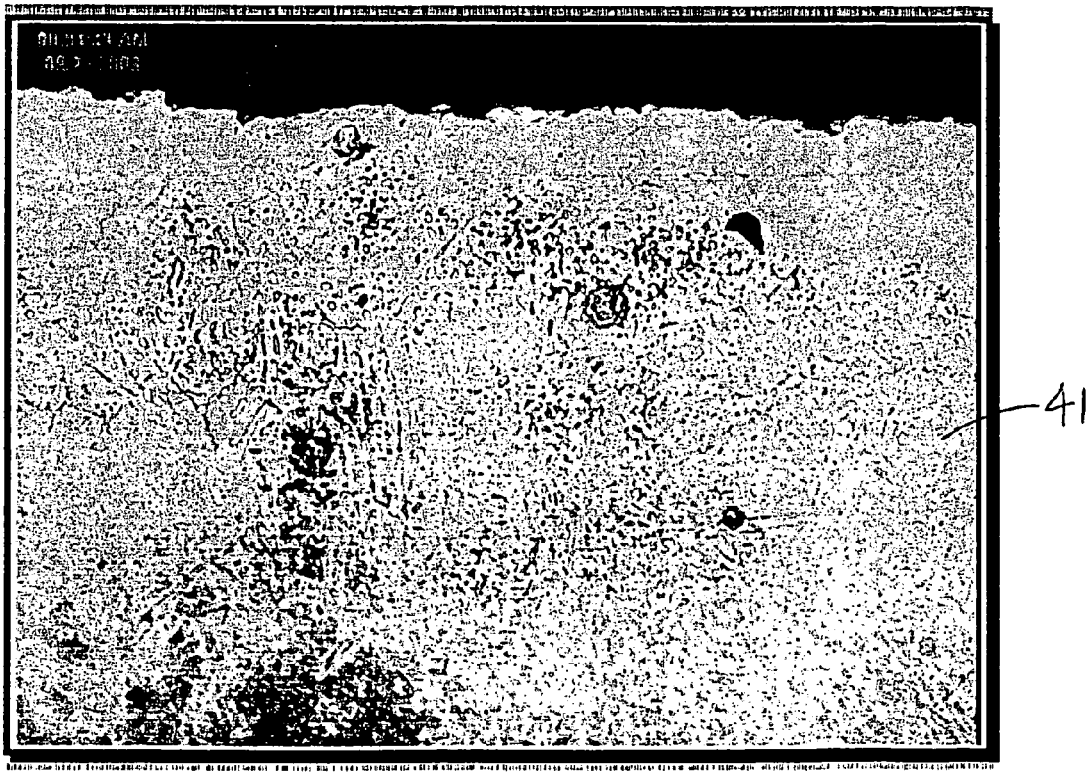
FIG. 9 is a micrograph illustrating the Pyrowear 675 carburized, hardened microstructure after annealing and grit blasted to remove the nickel plating.

With reference to FIGS. 7–9, there is illustrated moicrographs of the structure resulting from carburizing pyrowear 675 utilizing one form of the present invention. In FIG. 7, the nickel plating is present in region 40 and the carburized base material is represented in region 41. An enlarged version of region 41 is set forth in FIG. 8. Upon review of FIG. 8 the reader should note the fine uniformly dispersed carbides. With reference to FIG. 9, there is illustrated the carburized pyrowear 675 after being annealed and having the nickel plating stripped by grit blasting.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

What is claimed:

1. A method of increasing the hardness of a steel object, comprising:

applying a nickel plating to at least a portion of a surface of the steel object, said applying deposits the nickel plating having a thickness within a range of about 0.0005 inches to about 0.0025 inches;

subjecting the steel object to carburizing to allow carbon atoms to diffuse through the nickel plating and form a case portion;

removing the nickel plating from the steel object; and heat treating the steel object after said removing and the case portion having a hardness of at least Rc 50.

2. The method of claim 1, wherein the case portion having a hardness of at least Rc 50 at a depth up to about 0.090 inches.

3. The method of claim 1, wherein said applying includes an electroless nickel process.

4. The method of claim 1, which further includes annealing the steel object, and removing the nickel plating after said annealing and prior to said heat treating.

5. The method of claim 1, wherein said applying deposits the nickel plating having a thickness within a range of about 0.0005 inches to about 0.0015 inches.

6. The method of claim 1, wherein the steel object is defined by stainless steel.

7. The method of claim 1, wherein in said subjecting the carburizing includes vacuum carburizing.

8. The method of claim 7, wherein the vacuum carburizing includes evacuating the carburizing atmosphere to a sub-atmospheric pressure, heating the steel object to the carburizing temperature, admitting carburizing gas into the carburizing atmosphere and drawing a further vacuum that begins with the admitting of carburizing gas into the carburizing atmosphere.

9. The method of claim 1, which further includes masking a portion of the steel object prior to said applying to prevent nickel plating on the portion of the steel object.

10. The method of claim 1, wherein the steel object is stainless steel;

wherein in said subjecting the carburizing includes vacuum carburizing;

wherein in said applying the nickel plating is an electroless nickel plating having a thickness within a range of about 0.0005 inches to about 0,0015. inches; and which further includes annealing the steel object.

11. The method of claim 10, wherein in said subjecting the carburizing occurring at a carburizing temperature above ambient temperature, and wherein the nickel plating can withstand the carburizing temperature without melting.

12. The method of claim 11, wherein the nickel plating is a deposition alloy of about 96 to about 98 nickel and about 2 to 4 percent phosphorous by weight percent.

13. The method of claim 1, wherein said removing involves removing the entire nickel plating.

14. A method of processing a stainless steel object, comprising:

plating a surface of the stainless steel object with an electroless nickel material;

heating the stainless steel object to a carburizing temperature;

subjecting the steel object to carburizing wherein carbon atoms diffuse through the plating and form a case region;

removing at least a portion of the electroless nickel material after said subjecting; and hardening the case region of the stainless steel object after said removing.

15. The method of claim 14, which further includes annealing the stainless steel object after said subjecting, and which further includes performing said removing after said annealing.

16. The method of claim 14, wherein said plating deposits the electroless nickel material to a thickness within a range of about 0.0005 inches to about 0.0025 inches.

17. The method of claim 14, wherein said plating results in a substantially uniform coating having a thickness with a range of about 0.0005 inches to about 0.0015 includes;

which further includes annealing the steel object after said subjecting;

which further includes stabilizing the steel object after said hardening; and which further includes tempering the steel object after said stabilizing.

18. The method of claim 17, wherein the hardened case region having a hardness of at least Rc 50 at a depth greater than or equal to 0.012 inches.

19. The method of claim 17, wherein the hardened case region having a hardness of at least Rc 50 at a depth greater than or equal to 0.012 inches and up to about 0.090 inches.

20. The method of claim 18, wherein in said subjecting the carburizing occurring at a carburizing temperature above ambient temperature, and wherein the nickel plating can withstand the carburizing temperature without melting.

21. The method of claim 20, wherein the nickel plating is a deposition alloy of about 96 to about 98 nickel and about 2 to 4 percent phosphorous by weight percent, and wherein the carburizing is a vacuum carburizing.

22. The method of claim 14, which includes changing the carbide structure within the hardened case region by adjusting the thickness of said plating.

23. The method of claim 14, wherein said plating includes selecting the thickness of the nickel material to select the carbide formation in the case region.

24. The method of claim 14, which further includes controlling the thickness in said plating to control the formation of carbides in the case region, and wherein the steel object is formed of stainless steel.

25. A method comprising:

(a) applying an electroless nickel plating to a surface of a stainless steel object;

(b) placing the object within a mechanical housing;

(c) evacuating the environment within the mechanical housing to a sub-atmospheric pressure;

(d) heating the object within the mechanical housing to a carburizing temperature;

(e) introducing a carburizing gas into the mechanical housing for a first period of time;

(f) drawing a vacuum within the mechanical housing for a second period of time; and (g) repeating acts (c)–(f) a plurality of times; and (h) removing the nickel plating after said repeating and prior to hardening the stainless steel object.

26. The method of claim 25, which further includes a post carburizing passive diffusion act after said repeating to enable the carbon atoms to diffuse further into the object.

27. The method of claim 26, wherein said drawing commencing upon the beginning of said introducing act.

28. The method of claim 25 which further includes annealing the object after act (g) and prior to act (h);

which further includes hardening the object after said annealing;

which further includes cooling the object to a temperature below room temperature after said hardening; and which further includes tempering the object after said cooling.

29. The method of claim 28, wherein said applying deposits the nickel plating having a thickness within a range of about 0.0005 inches to about 0.0015 inches, and wherein the steel object having a hardened case region with a hardness of at least Rc 50 at a depth greater than or equal to about 0.012 inches.

30. The method of claim 29, wherein the steel object having a hardened case region with a hardness of at least Rc 50 at a depth of up to about 0.090 inches.

31. A method comprising:

(a) applying an electroless nickel plating to a surface of a stainless stel object;

(b) placing the object within a mechanical housing;

(c) evacuating the environment within the mechanical housing to a subj-atmospheric pressure;

(d) heating the object within the mechanical housing to a carburizing temperature, said heating to a temperature within a range of about 1600° F. to about 1700° F.;

(e) introducing a carburizing gas into the mechanical housing for a first period of time;

(f) drawing a vacuum within the mechanical housing for a second period of time; and (g) repeating acts (c)–(f) a plurality of times; and wherein said applying deposits a uniform nickel coating having a thickness within a range of about 0.0005 inches to about 0.0025 inches;

wherein said evacuating to a sub-atmospheric of about 1 torr;

wherein in said introducing the first period of time is about one minute;

wherein in said drawing the second period of time is about four minutes, and wherein said second period of time commencing when said introducing begins;

wherein said repeating occurring for 520 minutes.

32. The method of claim 25, wherein the nickel plating is a deposition alloy of about 96 to about 98 nickel and about 2 to 4 percent phosphorous by weight percent, and wherein the carburizing temperature is below the melting point of the nickel plating.

33. The method of claim 25, which includes adjusting the desired carbide structure within the hardened case region by adjusting the thickness of the plating.

34. The method of claim 25, which further includes controlling the thickness of the nickel plating to control the formation of carbides in the case region.

* * * * *

UNITED STATES PATENT AND TRADEMARK OFFICE

CERTIFICATE OF CORRECTION

PATENT NO. : 7,208,052 B2
APPLICATION NO. : 10/765300
DATED : April 24, 2007
INVENTOR(S) : Stephen N. Hammond et al.

It is certified that error appears in the above-identified patent and that said Letters Patent is hereby corrected as shown below:

In the Claims

Column 9, Claim 10, line 16:

At the end of claim 10, before the "." at the end of the sentence, add the words: prior to said heat treating.

Column 9, Claim 14, line 32:

Add the word stainless before the words steel object.

Column 10, Claim 31, line 55:

Remove the letter "j" from the word "sub".

Signed and Sealed this
Tenth Day of June, 2014

Michelle K. Lee

Michelle K. Lee
*Deputy Director of the United States Patent and Trademark Office*